US006220195B1

(12) United States Patent
Crews

(10) Patent No.: US 6,220,195 B1
(45) Date of Patent: Apr. 24, 2001

(54) TROLLING PLATE WITH IMPROVED FORCE TRANSMISSION LINKAGE

(75) Inventor: Douglas Crews, Seattle, WA (US)

(73) Assignee: Issaquah Development Co., Sequim, WA (US)

( * ) Notice: Subject to any disclaimer, the term of this patent is extended or adjusted under 35 U.S.C. 154(b) by 0 days.

(21) Appl. No.: 09/422,891

(22) Filed: Oct. 22, 1999

(51) Int. Cl.[7] ..... B63H 25/48
(52) U.S. Cl. ..... 114/145 A
(58) Field of Search ..... 114/145 A

(56) References Cited

U.S. PATENT DOCUMENTS

| | | |
|---|---|---|
| 3,603,277 | 9/1971 | Manary . |
| 3,965,838 | 6/1976 | Uht . |
| 4,549,498 | 10/1985 | Meyer et al. . |
| 5,005,507 | 4/1991 | Dyer . |
| 5,127,353 | 7/1992 | Wieser . |
| 5,493,990 | 2/1996 | Dyer . |
| 5,711,241 | 1/1998 | Dyer . |
| 5,715,768 | 2/1998 | Anderson . |

*Primary Examiner*—Sherman Basinger
(74) *Attorney, Agent, or Firm*—Graybeal Jackson Haley LLP

(57) ABSTRACT

An improved trolling plate design that incorporates an outdrive bracket to be attached to a watercraft outdrive, a rotationally linked thrust regulating plate, and a selector subassembly including user operable linkage to engage a plate subassembly extending from the thrust regulating plate. The plate subassembly uses a protruding member extending from the thrust exposed side of the plate to engage a dog pivotally linked to the outdrive bracket so that rotational forces of the plate are compressively transferred to the bracket. This arrangement of force transmission components eliminates elongation of prior art outdrive bracket slots and thrust regulation plate notches, the result being an improved force transmission linkage. Removal of the dog as an intermediary component from between the plate having the protruding member and the outdrive bracket can be accomplished by pivoting the dog so that the protruding member clears the same when the plate is rotated to a trolling position.

11 Claims, 5 Drawing Sheets

TROLLING PLATE WITH IMPROVED FORCE TRANSMISSION LINKAGE

TECHNICAL FIELD

The present invention relates to trolling plate assemblies for use with motorized watercraft, and more particularly relates to such an assembly wherein a robust linkage exists between the outdrive bracket and the thrust regulating plate.

BACKGROUND OF THE INVENTION

With recent advances in material science, and the consumer driven desire for larger and more powerful engines, recreational fishing vessels presently have more available power output than at anytime in the past. These vessels, however, are still used for trolling when fishing for certain types of game fish. As a consequence, unless a separate trolling motor is installed on the vessel, the primary propulsion system must be used. However, depending upon engine output and prop configuration, a desirable trolling speed of between 1.5 and 5 knots is often times impossible. Therefore, operators of such vessels must install a thrust mitigating device to decrease the propulsion efficiency of the watercraft. This device is generally referred to as a trolling plate.

Trolling plates are generally a structure that is attached to the secondary drive components of outboard or outdrive systems, usually by way of the anti-cavitation plate. These structures then are positioned directly in the thrust path of the prop, thereby reacting with the volume of water displaced by the prop in a rearward direction. As a consequence of placing the trolling plate in a trolling position and operating the drive system at idle or low speed, the propulsion system becomes inefficient, thereby decreasing the speed of the vessel.

Conventional trolling plates such as THE HAPPY TROLLER sold by Idea Development Company of Sequim, Washington, essentially rely on a mounting bracket attached to the secondary drive unit that has at its aft end a rotationally linked thrust reaction plate. The plate has an upper U-shaped portion that is adapted to receive a shaft horizontally and laterally positioned in the bracket. Slightly forward of this shaft is a spring loaded selector bar that selectively engages notch pairs formed in the U-shaped portion of the plate. This selector bar extends through the bracket so that when the plate reacts on the selector bar via the notches, it transmits forces to the bracket via the holes in the bracket that supports the selector bar.

While the described structure accomplishes the intended purpose of transmitting thrust forces from the prop to the drive unit, it does so via notches and holes formed in sheet material, usually aluminum, that may become worn over time, and are especially subject to excessive wear and potential failure when presented with high force thrusts that may emanate from high output engines or accidental over revving. It is thus desirable to have a trolling plate that is adapted to fit the secondary drive unit of an outboard or inboard/outboard drive system, but wherein thrust forces from the prop are transferred to the drive system by distinct linkages as opposed to using a notched plate to bracket to outdrive means.

SUMMARY OF THE INVENTION

The present invention is directed to a trolling plate assembly that provides a user with the option of establishing a trolling position or a non-trolling position when the invention is mounted to a drive or outdrive unit of a water craft. Unlike traditional trolling plate assemblies, the present trolling plate assembly provides a robust linkage between an outdrive bracket and a thrust regulating plate pivotally mounted to the bracket. More particularly, the outdrive bracket has an upper surface, a lower surface, a forward portion, and a rear portion, and defines a passage at the rear portion from the upper surface to the lower surface. The thrust regulating plate, as previously noted, is pivotally linked to the outdrive bracket at the rear portion thereof wherein the plate is positionable to establish a trolling position that diminishes the effective thrust of the drive unit and a second position, wherein the thrust regulating plate has a first surface that faces at least partially towards the drive unit when in the trolling position, and a second opposing surface.

A selector subassembly comprising a user operable linkage is located at the passage and partially extends therethrough. The selector subassembly operates to selectively obstruct rotational movement of the thrust regulating plate. When selected to obstruct rearward rotational movement of the thrust regulating plate, forces presented to the regulating plate are transmitted to the outdrive bracket though the linkage. The selector subassembly may, but need not, positively engage a plate subassembly mounted to the first surface of the thrust regulating plate, as it need only contact the plate subassembly when the same is caused to pivot upon exposure to thrust created by the drive unit. The plate subassembly generally comprises a protruding member adapted to selectively engage or otherwise contact the user operable linkage.

It is to be understood that the invention concerns the establishment of a force transmitting linkage between the outdrive bracket and the thrust regulating plate that does not rely upon slots or notches in either the outdrive bracket or the thrust regulating plate. Thus, alternative embodiments may include the use of a plunger (spring-biased or gravity-biased) that depends from the upper surface of the bracket and selectively engages an ancillary structure affixed to the thrust regulating plate. When in the extended position, it contacts the ancillary structure by obstructing the free rotation thereof when the thrust regulating plate is in the trolling position, and when in the retracted position, permits free rotation of the thrust regulating plate from the trolling position.

Features of the invention include the incorporation of a selector bar for positively establishing the second position as has been done previously in the prior art. In a preferred form, the rear portion of the outdrive bracket includes a pair of upturned portions, each defining a slot, and the selector subassembly further comprises a selector bar disposed in the opposed slots and linked to the bracket by at least one biasing member wherein the selector bar is locatable in a portion of the thrust regulating plate when the same is in the second position. The user will then operate the selector bar to engage and disengage the thrust reaction plate into and from the non-trolling position.

DETAILED DESCRIPTION OF A PREFERRED EMBODIMENT

Figure 1:
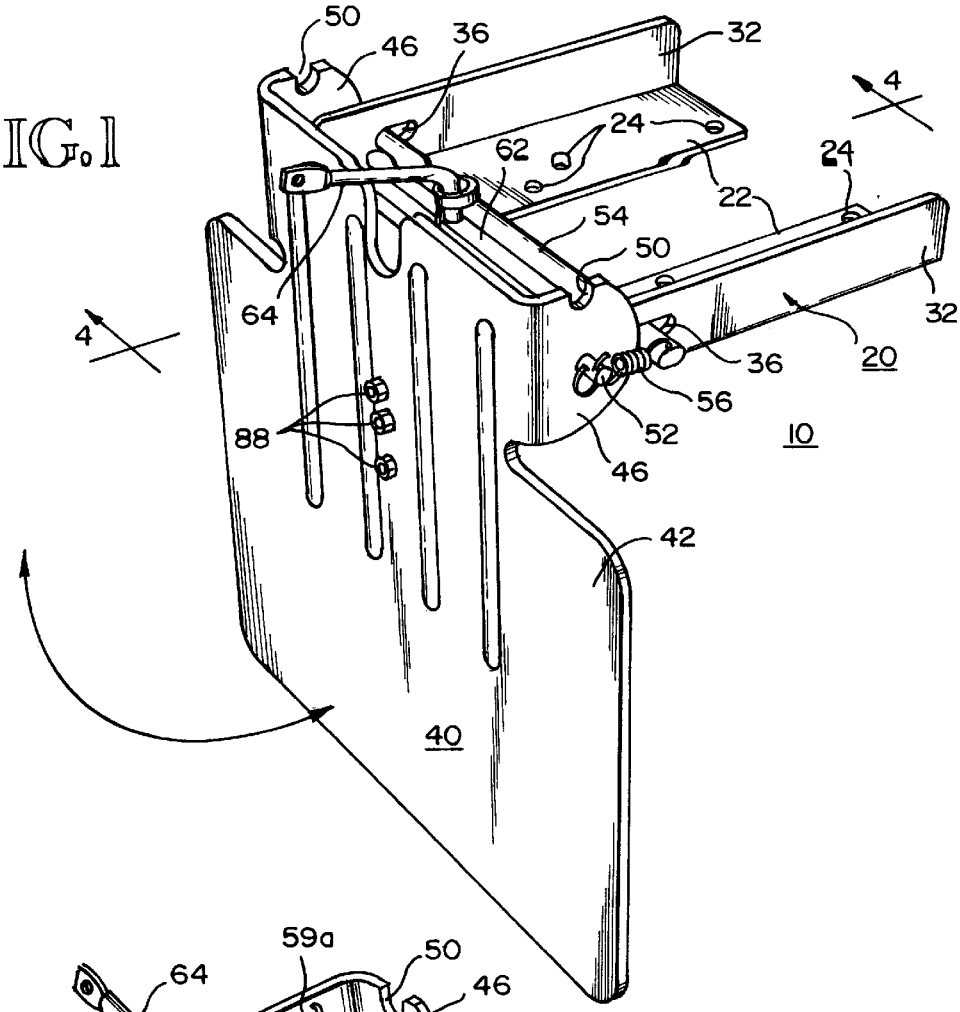
FIG. 1 is a perspective elevation view of the trolling assembly showing the relative positions of the outdrive bracket and thrust regulating plate.
Figure 2:
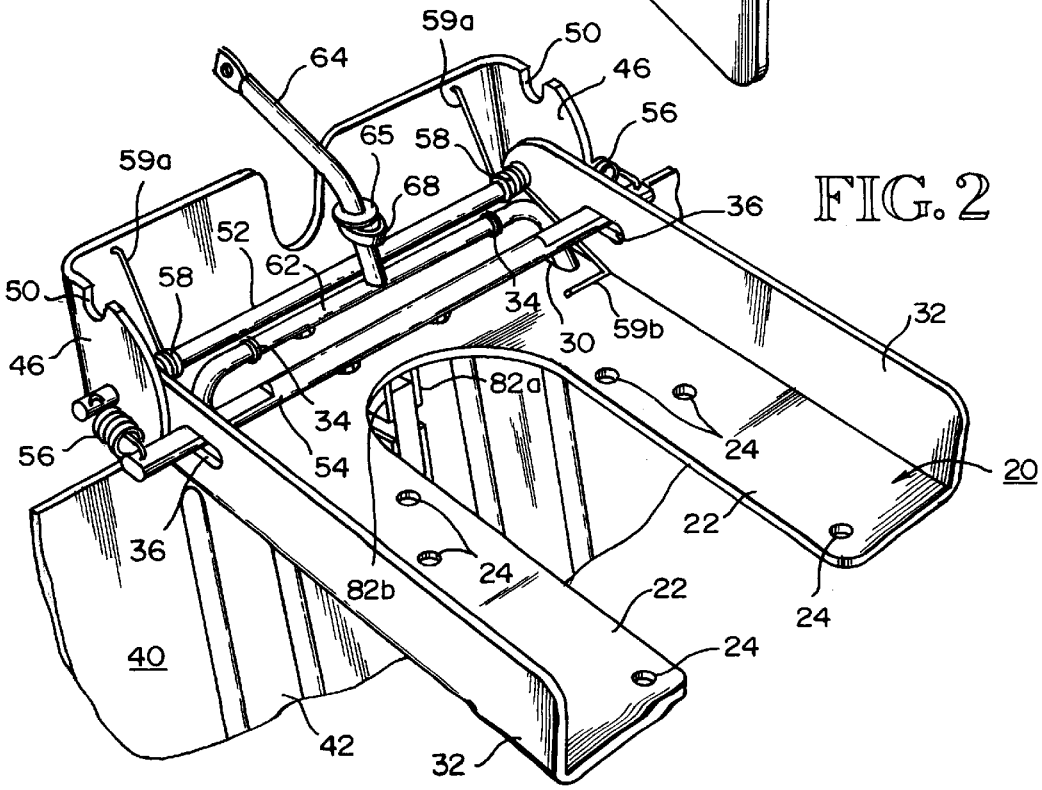
FIG. 2 is a partial perspective view of the trolling assembly of FIG. 1 wherein the selector subassembly is detailed.
Figure 4:
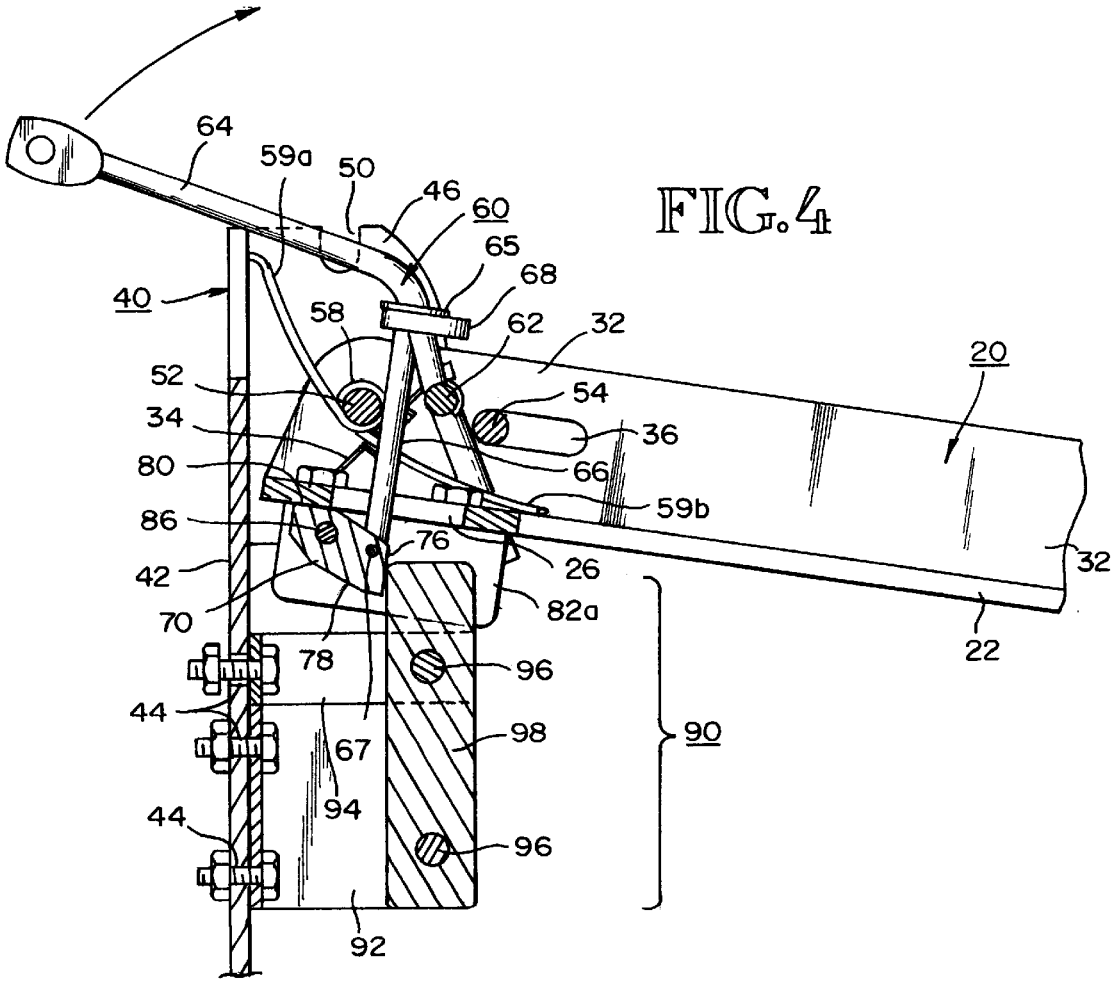
FIG. 4 is a partial cross-sectional view of the trolling assembly shown in FIG. 1 taken substantially along the lines 4—4 shown therein.

Turning then to the several Figures wherein like numerals indicate like parts, and more particularly to FIGS. 1 and 2, trolling assembly 10 is best shown, and unless otherwise indicated, all components are constructed of high-quality stainless steel and aluminum. Trolling assembly 10 has four major components, namely outdrive bracket 20, thrust regulating plate 40, selector subassembly 60 (FIG. 4), and plate subassembly 90 (FIG. 4). Outdrive bracket 20 is preferably formed from a single piece of 3/16" thick aluminum and is formed to include horizontal portion 22 and vertical portions 32. Horizontal portion 22 defines holes 24, which receive bolts (not shown) to facilitate attachment of trolling assembly 10 to the anti-cavitation plate of an outdrive. Vertical portions 32 defined slots 36 to receive selector bar 54, and a pair of holes to receive pivot shaft 52. Thrust regulating plate 40 is also constructed of 3/16" thick aluminum, and has holes formed therein to receive nut and bolt combinations 88 in main portion 42 and pivot shaft 52 in return portions 46. Return portions 46 also defined a pair of notches 50 that selectively receive portions of selector bar 54 as will be shown below.

As best shown in FIG. 2, thrust regulating plate 40 is pivotally attached to outdrive bracket 20 by way of pivot shaft 52. Thrust regulating plate 40 is biased to the trolling positioned as shown in FIG. 1 through torsion springs 58. As clearly illustrated in FIG. 2, torsion spring ends 59*a* press upon the upper portion of main portion 42, and torsion spring ends 59*b* press upon horizontal portion 22. The result of these forces causes rotation of thrust regulating plate 40 to achieve a trolling position.

Figure 6:
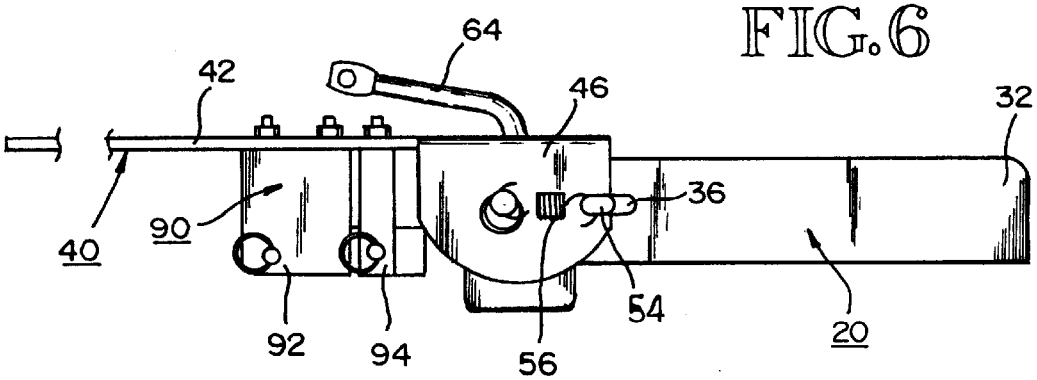
FIG. 6 is a side elevation view of the trolling assembly when in a trailing state.

Momentarily referring to FIG. 6, it can be seen that when thrust regulating plate 40 is in the non-trolling position, springs 56 cause selector bar 54 to locate in notches 50. In this manner, thrust regulating plate 40 will not pivotally move relative to outdrive bracket 20 unless a mechanical force sufficient to overcome the spring-biased retention of selector bar 54 in notch 50 is presented via handle 64.

Figure 3:
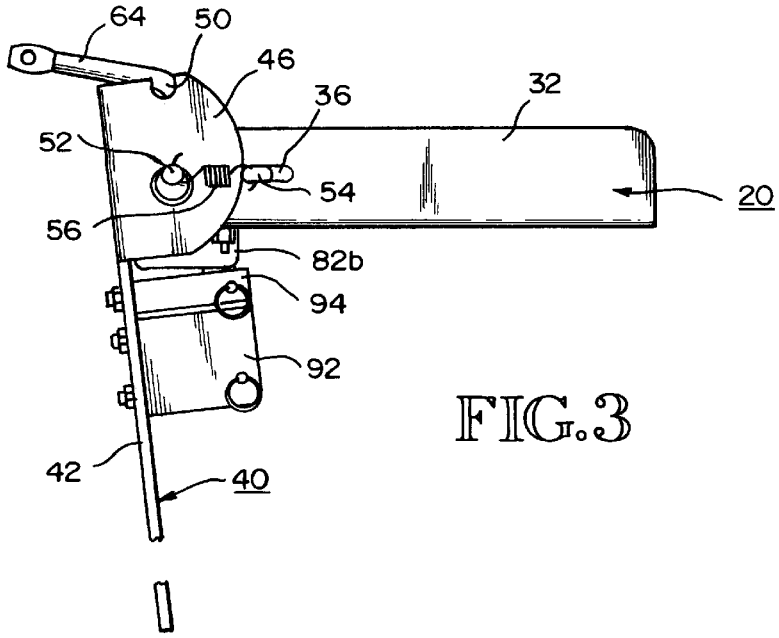
FIG. 3 is a side elevation view of the trolling assembly of FIG. 1.
Figure 7:
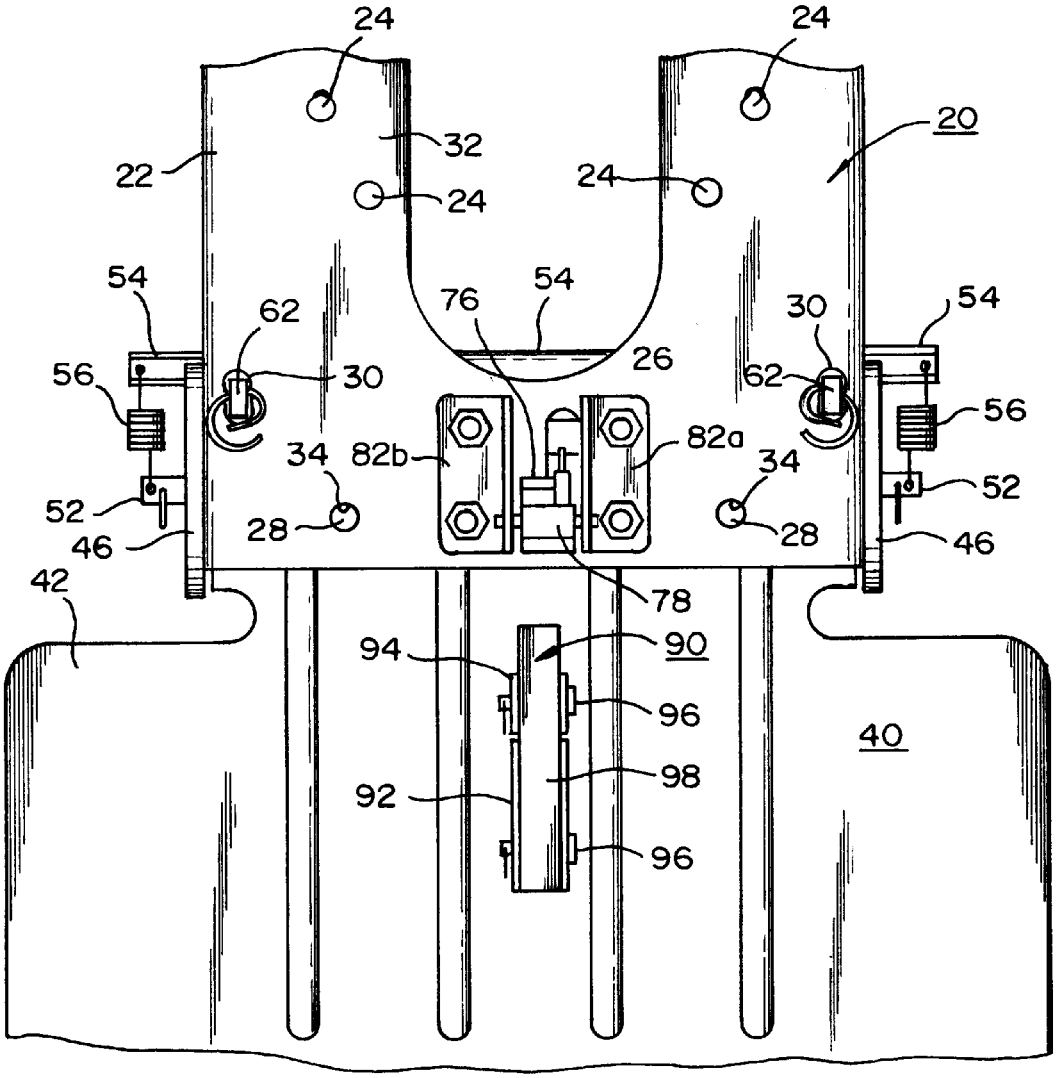
FIG. 7 is an elevation view of the trolling assembly detailing the various components of the selector subassembly and plate subassembly.

Discussion will now be directed to selector subassembly 60 and plate subassembly 90. Referring to FIGS. 3 and 4, thrust regulating plate 40 is shown in the locked trolling position. In this position, selector bar 54 is not utilized. Instead, selector subassembly 60, which includes U-shaped bar 62, springs 34, handle 64, linking bar 66, elliptical member 68, and dog 70, interacts with plate subassembly 90. As will be described in more detail below, all thrust forces generated by the watercraft's propeller against thrust regulating plate 40 will be transmitted to outdrive 20 through robust structural members. As briefly described above, selector subassembly 60 includes U-shaped bar 62 which is disposed in slots 30 (shown in FIGS. 2 and 7) formed in horizontal portion 22 to which is attached handle 64. Linked to handle 64 is linking bar 66 having affixed thereto elliptical member 68. Washer 65 is affixed to handle 64, and interacts with elliptical member 68. In this manner, handle 64 and U-shaped bar 62 are prevented from dropping further into slots 30. Linking bar 66, which is disposed in slot 26 defined by horizontal portion 22, includes pin 67 for associating linking bar 66 with dog 70. In turn, dog 70 is rotationally linked with brackets 82*a* and 82*b* by way of pin 86. As a consequence of this configuration, when an upward force is presented to linking bar 66, dog 70 is caused to rotate about pin 86. The upward forces are generated by the interaction of elliptical member 68 contacting with U-shaped bar 62 as it drops down along handle 64.

Figure 5:
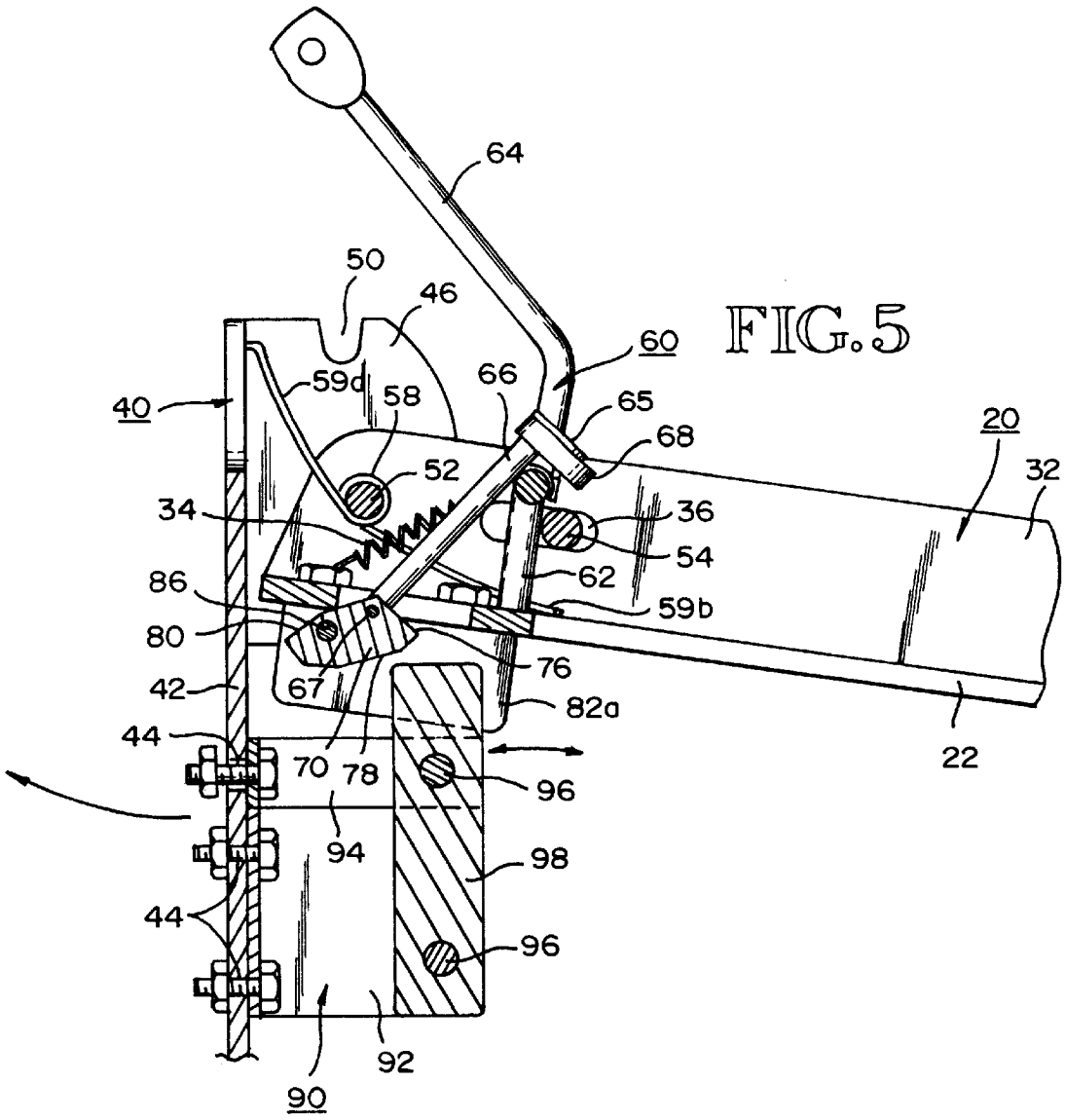
FIG. 5 is a similar cross-sectional view to that of FIG. 4 but the selector subassembly is shown in the active state and further details the engagement and disengagement of the selector subassembly from the plate subassembly.

Dog 70 acts as an intermediary between movable plate subassembly 90 and fixed outdrive bracket 20. As shown in FIG. 4, any thrust presented against thrust regulating plate 40 will cause a rearward force to be presented upon surface 76 of dog 70. This rearward force is then transmitted via dog 70 to horizontal portion 22 of outdrive bracket 20 at the interface of surface 80 of dog 70 and the lower portion of horizontal portion 22. When it is desired to disengage from the trolling position, handle 64 is pivotally rotated upwardly as best shown in FIGS. 5 and 6. In so doing, the tension bias of springs 34 on U-shaped bar 62 is overcome, and U-shaped bar 62 presses against and causes selector bar 54 to move to the forward portion of slots 36. Simultaneously, dog 70 is rotated about pin 86 thereby displacing dog 70 from plate 98. Once plate 98 is free from interference with surface 76 of dog 70, thrust applied against thrust regulating plate 40 by the watercrafts propeller causes outward rotation of thrust regulating plate 40, whereafter tension exerted by springs 56 causes bar 54 to locate in notches 50 when thrust regulating plate 40 achieves the trailing position.

To establish a trolling position, handle 64 is pivoted towards the watercraft, thereby disengaging selector bar 54 for from notches 50, whereafter torsion springs 58 cause the inward or downward rotation of thrust regulating plate 40 to the trolling position. Because linking bar 66 exerts no downward bias upon dog 70 apart from gravitational forces, surface 78 of dog 70 is capable of riding up and over the upper portion of plate 98 until dog 70 achieves the position shown in FIG. 4.

Figure 8:
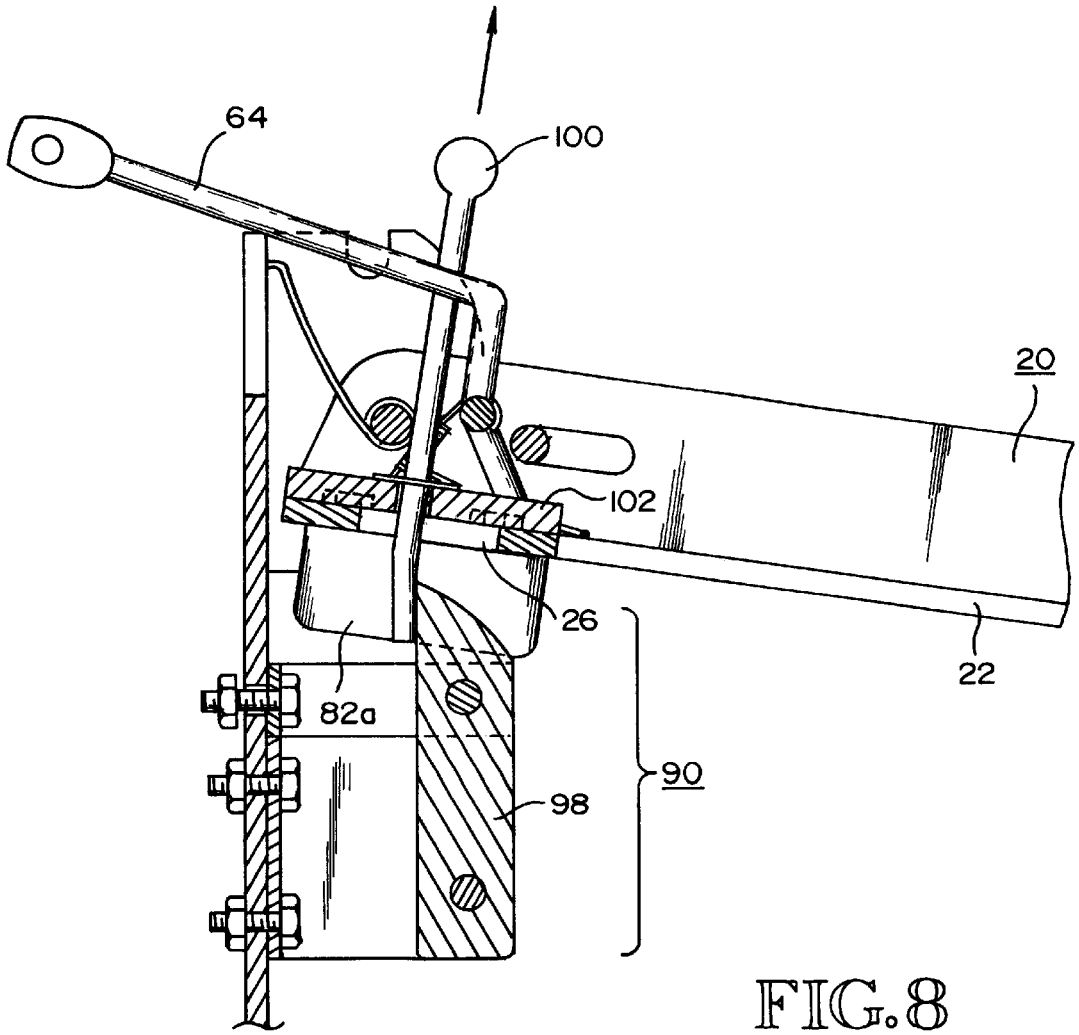
FIG. 8 is an elevation view similar to that of FIG. 4 but wherein a plunger linkage is used to prevent rearward rotation of the plate subassembly.

While the embodiment set forth in FIGS. 1–7 illustrates the preferred embodiment, alternative forms also exist. In FIG. 8, the robust selector subassembly 60 is modified so that a single plunger 100 is disposed in slot 26 to thereby selectively engage plate 98. To provide a sufficient structure to transfer shear forces presented to plunger 100 to bracket 20, collar 102 is fixedly attached to horizontal portion 22. Depending upon design considerations, it is equally appropriate to locate collar 102 on the underside of horizontal portion 22. To disengage plunger 100 from plate subassembly 90, the user need only lift plunger 100 as indicated by the arrow. To facilitate engaging operations of is plunger 100, plate 98 may be sloped as illustrated thereby creating a ramp so that plunger 100 will naturally elevate when thrust regulating plate 40 is permitted to rotate into the trolling position.

What is claimed:

1. A trolling plate assembly mountable to a drive unit of a watercraft comprising:

an outdrive bracket having an upper surface, a lower surface, a forward portion, and a rear portion, and defining a passage at the rear portion from the upper surface to the lower surface;

a thrust regulating plate pivotally linked to the outdrive bracket at the rear portion wherein the plate is positionable to establish a trolling position that diminishes effective thrust of the drive unit and a second position, wherein the thrust regulating plate has a first surface that faces at least partially towards the drive unit when in the trolling position, and a second opposing surface;

a selector subassembly comprising a user operable linkage located at the outdrive bracket passage, a lower portion of which partially extends through the outdrive bracket passage; and a plate subassembly extending from the first surface of the thrust regulating plate comprising a protruding member adapted to engage the lower portion of the user operable linkage wherein the user operable linkage prevents rearward rotation of the thrust regulating plate by obstructing movement of the protruding member when the thrust regulating plate is in the trolling position.

2. The trolling plate assembly of claim 1 wherein the user operable linkage comprises a reciprocating plunger member having a first end, a second end, and a body portion wherein a mount affixed to the bracket supports the plunger member and the first end obstructs rotation of the protruding member, the body portion contacts the mount, and the second end is used by a user to retract the plunger member away from the protruding member.

3. The trolling plate assembly of claim 2 wherein the outdrive bracket further defines a pair of opposed slots and the selector subassembly further comprises a selector bar disposed in the pair of opposed slots and linked to the bracket by at least one biasing member wherein the selector bar is locatable in a portion of the thrust regulating plate when the same is in the second position.

4. The trolling plate assembly of claim 3 wherein the selector subassembly further comprises a handle assembly and wherein the second end of the plunger member is linked to the handle assembly and the handle assembly selectively moves the selector bar in response to user operation of the handle assembly.

5. The trolling plate assembly of claim 1 wherein the user operable linkage comprises a linking bar having a first end, a second end and a body portion, and a dog pivotally linked to the first end of the linking bar and pivotally linked to the bracket wherein a first surface of the dog is proximate to the protruding member and a second surface of the dog is proximate to the bracket when the thrust regulating plate is in the trolling position.

6. The trolling plate assembly of claim 5 wherein the outdrive bracket further defines a pair of opposed slots and the selector subassembly further comprises a selector bar disposed in the pair of opposed slots and linked to the bracket by at least one biasing member wherein the selector bar is locatable in a portion of the thrust regulating plate when the same is in the second position.

7. The trolling plate assembly of claim 6 wherein the selector subassembly further comprises a handle assembly wherein the linking bar is linked to the handle assembly and the handle assembly selectively moves the selector bar in response to user operation of the handle assembly.

8. The trolling plate assembly of claim 1 wherein the thrust regulating plate comprises a U-shaped portion having two legs, each leg defining a hole formed in an interior location of the leg and a notch formed in a peripheral location of the leg; wherein the outdrive bracket comprises a U-shaped portion having two legs, each leg defining a hole formed in an interior location of the leg; wherein the thrust regulating plate is rotationally linked to the outdrive bracket by locating a shaft simultaneously in the holes formed in each leg; and wherein the user operable linkage comprises a linking bar having a first end, a second end and a body portion, and a dog pivotally linked to the first end of the linking bar and pivotally linked to the bracket wherein a first surface of the dog is proximate to the protruding member and a second surface of the dog is proximate to the bracket when the thrust regulating plate is in the trolling position.

9. A trolling plate assembly mountable to a drive unit of a watercraft comprising:

an outdrive bracket having an upper surface, a lower surface, a first and a second side surface generally opposed to one another, a forward portion, and a rear portion, wherein the rear portion defines a passage between the upper surface and the lower surface, and the first and second side surfaces each define a hole;

a thrust regulating plate having a main portion and a U-shaped portion defining a pair of opposing holes wherein the plate is pivotally linked to the first and second side surfaces of the outdrive bracket by a shaft disposed in the U-shaped portion of the plate and the side surfaces of the bracket, wherein the plate is positionable to establish a trolling position that diminishes effective thrust of the drive unit and a second position, and wherein the thrust regulating plate presents a first surface that faces at least partially towards the drive unit when in the trolling position;

a plate subassembly extending from the first surface of the thrust regulating plate comprising a protruding member; and a selector subassembly located at the outdrive bracket passage and partially extending there through and comprising a user operable linkage including a linking bar having a first end, a second end and a body portion, and a dog pivotally linked to the first end of the linking bar and pivotally linked to the bracket wherein a first surface of the dog is proximate to the protruding member and a second surface of the dog is proximate to the bracket when the thrust regulating plate is in the trolling position wherein the user operable linkage prevents rearward rotation of the thrust regulating plate by obstructing movement of the protruding member when the thrust regulating plate is in the trolling position.

10. The trolling plate assembly of claim 9 further comprising a selector bar disposed in a pair of opposed slots defined by the first and second side surfaces of the bracket and linked to the bracket by at least one biasing member wherein the selector bar is locatable in notches formed in the U-shaped portion of the thrust regulating plate when the same is in the second position.

11. The trolling plate assembly of claim 9 further comprising at least one biasing member to cause unidirectional rotation of the thrust regulating plate relative to the outdrive bracket.

* * * * *